United States Patent [19]

Buffalo

[11] Patent Number: 4,900,286

[45] Date of Patent: Feb. 13, 1990

[54] MODEL AIRPLANE HOLDER TOY

[76] Inventor: Vann M. Buffalo, 53 Tally Ho La., Little Rock, Ark. 72207

[21] Appl. No.: 279,782

[22] Filed: Dec. 5, 1988

[51] Int. Cl.[4] ..... A63H 27/04

[52] U.S. Cl. ..... 446/30; 446/490

[58] Field of Search ..... 446/30, 31, 34, 177, 446/176, 230–232, 490, 491; 272/31 A, 31 B; 40/413

[56] References Cited

U.S. PATENT DOCUMENTS

| | | | |
|---|---|---|---|
| 2,227,918 | 1/1941 | Trombla | 446/230 X |
| 2,779,595 | 1/1957 | Ensley | 446/30 X |
| 2,908,996 | 10/1959 | Humphrey | 446/177 |
| 2,921,405 | 1/1960 | Perkins | 446/30 |

*Primary Examiner*—Mickey Yu

*Attorney, Agent, or Firm*—Stephen D. Carver

[57] ABSTRACT

A toy for mounting a model airplane upon the window of a vehicle so that a child occupant thereof may play with the toy and simulate flight movements as the vehicle moves. A mounting platform is attached to the rear window of the vehicle via a plurality of suction cups. A rigid, preferably plastic stanchion operationally extends outwardly from the platform generally perpendicular to the window. A coupling assembly, preferably an elongated shaft, is rotatably coupled to the support stachion in spaced relation relative to the mounting platform. An elongated cable assembly terminates in a handle adapted to be disposed within the vehicle and grasped by the child an opposite end adapted to be removably attached to the coupling assembly to secure the model airplane. Once the mounting platform is suitably mounted upon a highly visible area of the back window and the cable is suitably routed from the vehicle interior out through the window, the child's model airplane can be twisted and manipulated from the interior of the vehicle as the air rushing by the window moves it vigorously.

9 Claims, 3 Drawing Sheets

MODEL AIRPLANE HOLDER TOY

BACKGROUND OF THE INVENTION

The present invention relates generally to toy airplanes, including plastic model airplanes of the type assembled by children. More particularly, the present invention is related to a system for playfully mounting a model airplane upon a vehicle window so that the toy can be controlled by the child occupant, usually in the back seat, as the vehicle moves.

As will be appreciated by those skilled in the toy arts, a great deal of interest exists in model airplane building. A wide variety of plastic model airplanes are currently available for children and other hobbyists. Once the airplanes are assembled, they are usually placed upon a rack for display, but all too often they are simply stored and then ignored by the child. I have found that many model airplanes so accurately emulate actual airplanes that they possess useful and stimulating flight characteristics. In other words, when properly exposed to high velocity air, they tend to exhibit certain interesting aerodynamic characteristics, lending them to playful flight simulations. Also, as will be well appreciated by those familiar with children, and particularly those who have experienced difficulties in entertaining a child sitting in the back seat of an automobile during a long automobile trip, some form of toy which can stimulate the child's interest and occupy his hours during a trip in a vehicle would be highly prized. Hence it would seem desirable to provide a system for allowing a child to constructively play with his model airplane toys after they have been assembled.

With respect to known prior art, a toy shown in U.S. Pat. No. 2,206,750 provides a rotatable system for controlling a model airplane and simulating flight. In this device the top of a model airplane is hooked to a control rod above ground, and the plane maybe variously manipulated by the child.

Abernethy Pat. No. 2,281,656 depicts a system wherein a plurality of model airplanes maybe rotated about a lower support stand. A plurality of control rods rotatably secured above the support stand are each coupled to individual model planes by a support string. Similarly, U.S. Pat. No. 2,739,416 depicts a rather complex tethered model airplane system which enables a child to manipulate a model plane. However, it includes a plurality of control members which are coupled to various portions of the airplane in a complex fashion.

U.S. Pat. No. 2,075,267 issued Mar. 30, 1937 also discloses a system for rotating a model airplane about a fixed position. U.S. Pat. No. 3,858,872 issued Jan. 7, 1975 discloses a system for controlling a captive flying toy through a remote mechanical system located outside of the orbit of the flying toy. Shapiro Pat. No. 2,644,271 discloses a launching system for model gliders. U.S. Pat. No. 2,669,403 discloses a glider carrying and releasing device for kites.

U.S. Pat. No. 3,140,560 and Design Pat. No. 157,535 both disclose the type of display or mounting systems which are typically employed to display models once they are assembled. U.S. Pat. No. 2,724,210 discloses another toy flight simulating device.

However, no prior art device known to me provides a system for mounting a model airplane externally of a vehicle, so that a child may play with it as the vehicle is driving. Moreover, I am unaware of any cable mounting system or toy mounting emulation system which is usable in conjunction with the window of a car, preferably the back seat, to enable a child to gleefully play with his model airplanes by subjecting them to the rush of air as the vehicle moves.

SUMMARY OF THE INVENTION

The present invention comprises a system ideally adapted to mount a toy model airplane upon the window of a vehicle so that a child occupant thereof may play with the toy as the vehicle moves.

Preferably the invention comprises a mounting platform adapted to be securely coupled to a window (preferably the rear) of the vehicle via a plurality of conventional suction cups. A rigid, preferably plastic stanchion extends upwardly from the platform, and when the system is installed upon the back window, the stanchion will project outwardly from the vehicle. A coupling assembly, preferably comprising an elongated rod, is rotatably coupled to the support stanchion in spaced relation relative to the mounting platform.

The system also contemplates an elongated cable assembly comprising a handle adapted to be disposed within the vehicle, and a terminal end adapted to be removably attached to the coupling assembly. Once the mounting platform is suitably mounted upon a highly visible area of the back window, and the cable is suitably routed from the vehicle interior out through the window, the child's model airplane can be twisted and manipulated from the interior of the vehicle as the air rushing by the window moves it vigorously.

The coupling assembly shaft may be coupled to the airplane by toy control clip extending from the body of the plane and terminating in a suitable slot defined within the control assembly rod. Similarly, a cable control end of the coupling shaft is connected to the cable, so that the shaft is rotatable from the inside of the vehicle by the child via the cable.

Thus a broad object of the present invention is to provide a system for enabling a child to play with his toy airplanes as a vehicle moves.

A more particular object is to provide a system for enabling a child disposed within the back seat of a vehicle to play with a model airplane operationally secured relative to the back seat window of the vehicle.

Yet another object of the present invention is to provide amusement for children during long rides.

A still further object of the present invention is to stimulate the interest of children in observing the characteristics of their toy airplane models.

It is also a general object of the present invention to stimulate childrens' interest in model airplanes.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
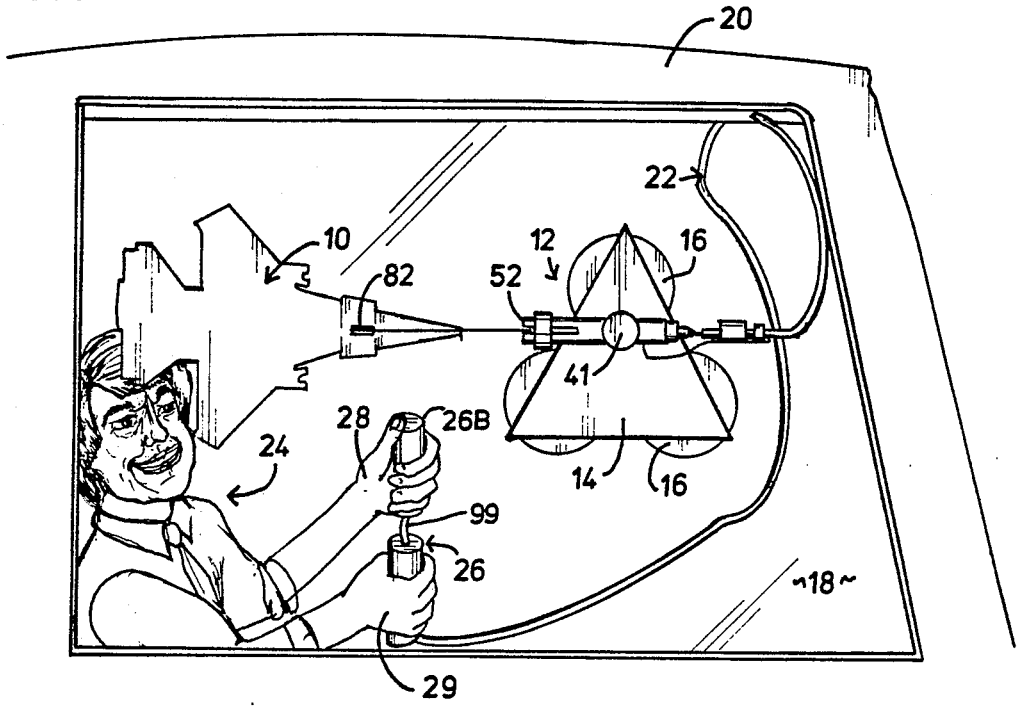
FIG. 1 is a fragmentary, pictorial view illustrating the system of the present invention properly deployed upon the exterior of a vehicle window, with the cable system illustrated within the vehicle interior in the hands of a typical child.

With initial reference now directed to FIG. 1 of the appended drawings, a plastic model airplane generally designated by the reference numeral 10 is illustrated coupled to the mounting system of the present invention. The instant toy 12 is adapted to secure the model airplane over the rear passenger window of a vehicle so that a child disposed in the back seat may enthusiastically play during a trip in the car.

The toy 12 comprises a rigid, preferably translucent, plastic mounting plate 14 which is attached via conventional suction cups 16 to the window 18 of a vehicle 20. An elongated control cable assembly, generally designated by the reference numeral 22, extends from the vehicle interior to the toy for controlling the model airplane 10 as the vehicle moves through the air. Child 24 holds a control handle, generally designated by the reference numeral 26, within his hands 28, 29. As child 24 manipulates handle system 26 in the manner to be hereinafter described, the model airplane 10 will be twisted within the air rushing by the vehicle.

With additional reference now directed to FIGS. 2 through 6, the mounting plate 14 is preferably formed of translucent plastic, and in the best mode it is of generally triangular configuration. Thus it includes a plurality of corners 14A, 14B and 14C (FIG. 6), each of which is provided with an adjacent mounting orifice 27 for coupling to conventional suction cups 16, which are pressed unto the surface of the window glass 18. Suitable screws 27S are fitted through mounting orifices 27 downwardly into the shank 30 of the suction cups 16 to secure them to mounting plate 14.

A rigid, preferably plastic collar 33 is fitted generally within the middle of the mounting plate 14 between the various suction cup mounting orifices 27. Collar 33 rigidly receives an elongated, rigid stanchion 36 which extends upwardly, generally perpendicularly to plate 14. Thus it will be apparent that once the plate 14 is appropriately pressed upon and suction-mounted to the vehicle window 18, stanchion 36 will extend outwardly away from the car 20. Stanchion 36 comprises a transverse bore 40 (FIG. 6) generally disposed adjacent its outermost end 41. Bore 40 is adapted to operatively receive coupling assembly, broadly designated by the reference numeral 44.

Coupling assembly 44 comprises an elongated, rigid, cylindrical shaft 47 which is adapted to be fitted through stanchion bore 40 whereby shaft 47 may be rotated relative to the stanchion 36. A pair of retainer washers 49, 50 (FIGS. 2–4) are disposed immediately opposite the outer edges of stanchion 36 upon shaft 47 to prevent inadvertent axial withdrawal of shaft 47. Shaft 47 comprises a toy control end 52 and a spaced apart cable control end 54. Both of these ends are slotted along a substantial portion of the length of shaft 47. The toy control slot is designated by the reference numeral 52B, and the cable control slot by reference numeral 54B.

Figure 2:
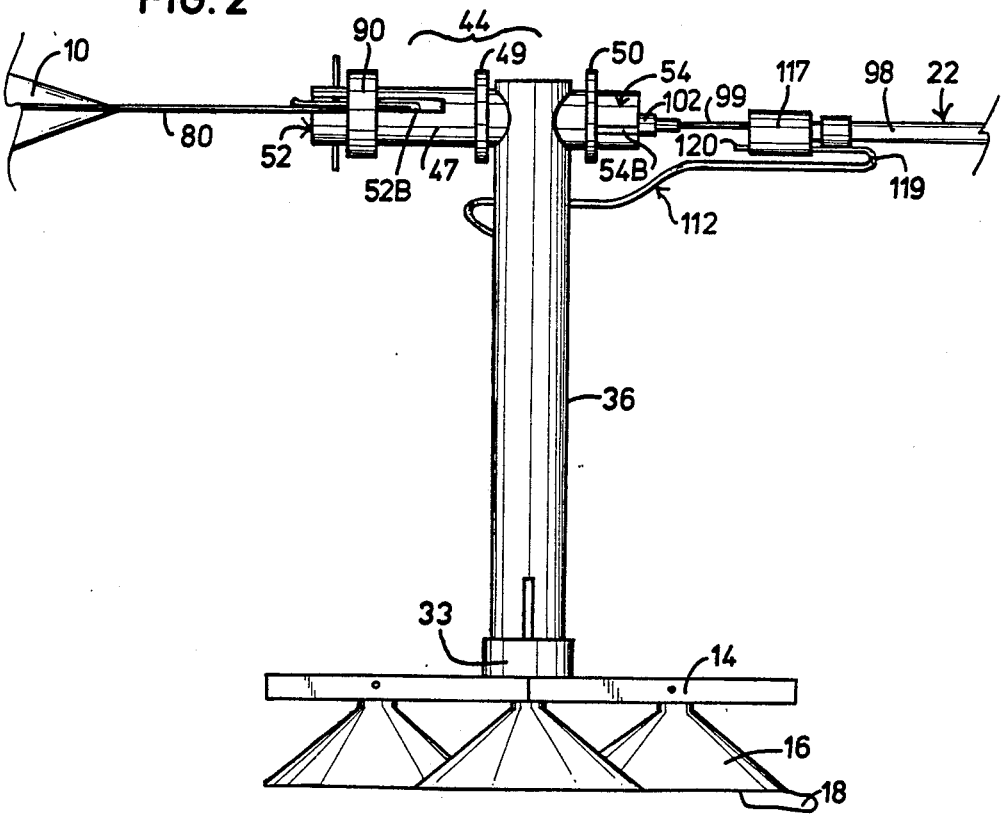
FIG. 2 is an enlarged, fragmentary side elevational view of the mounting assembly thereof.
Figure 3:
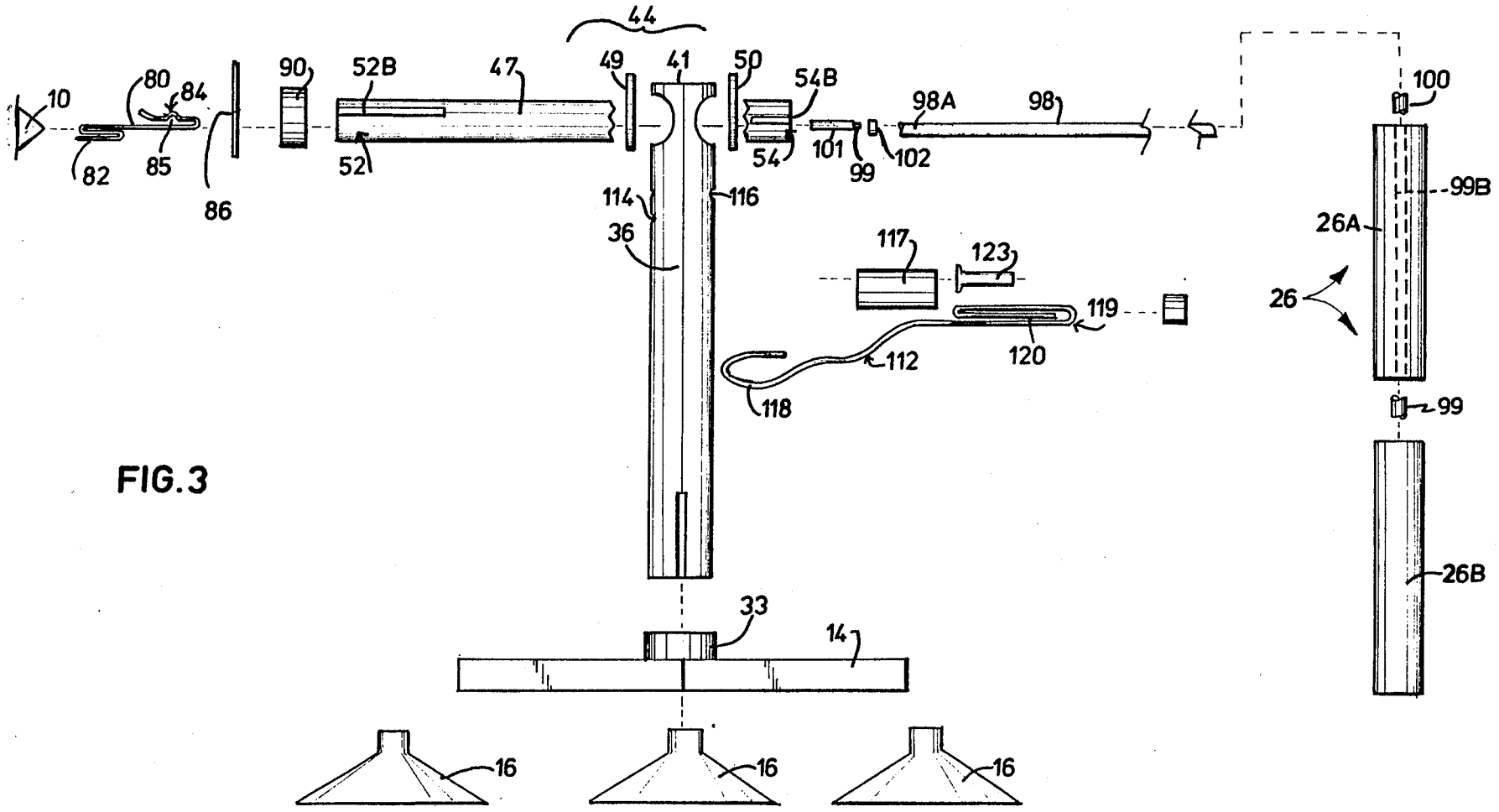
FIG. 3 is a fragmentary, exploded assembly view of the mounting system thereof.
Figure 5:
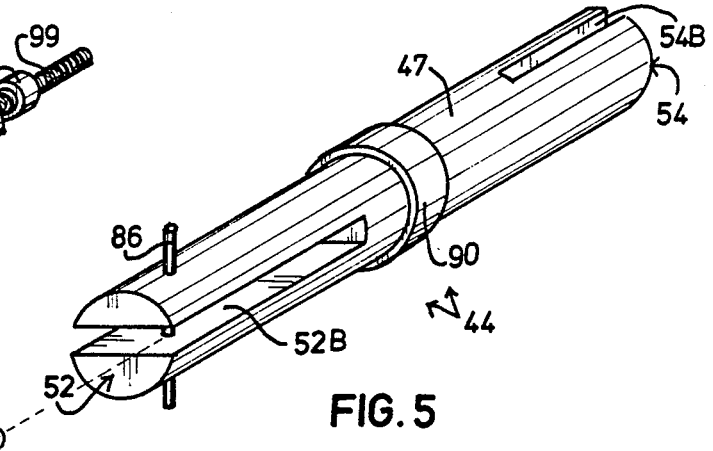
FIG. 5 is an enlarged, exploded, side perspective view of the preferred coupling assembly thereof; and, FIG. 6 is an enlarged, fragmentary, exploded, isometric view of the preferred base thereof.
Figure 6:
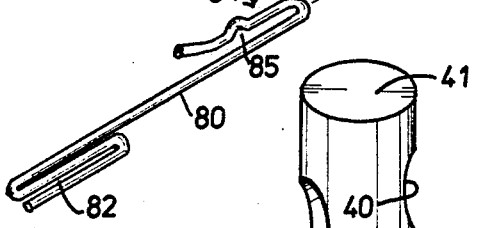
Figure 6:
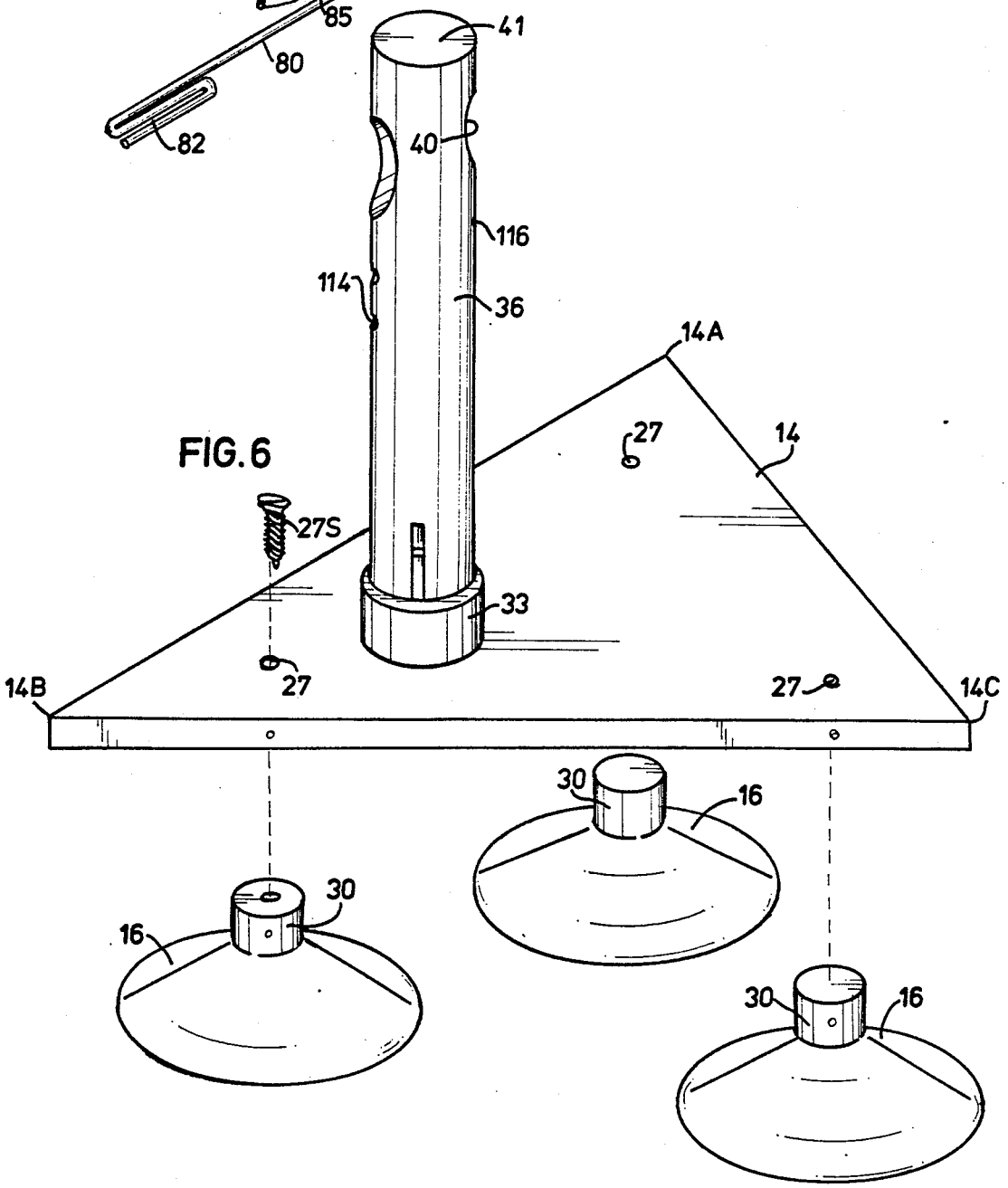

With particular reference now directed to FIGS. 2, 3 and 5, the model airplane control end 52 of the coupling shaft 47 is linked to the body of model airplane 10 by a rigid, preferable metallic clip 80. Clip 80 includes a folded rearward portion 82 adapted to be secured directly within the body of airplane 10, and a hook-like end 84 adapted to be received within slot 52B. A hollow portion 85 within hook end 84 will be penetrated by a mounting pin 86 (FIG. 5) which extends through the shaft 47 across slot 52B. Thus clip 80 will firmly retain and control movement of the model airplane, since it cannot escape from slot 52B. In addition, rotational movements of clip 80 relative to retainer clip 86 are limited by an elastic ring 90 (FIGS. 2, 3, and 5) which is axially slid towards end 52 to prevent escape of clip 80 and its captivated model airplane.

The cable assembly 22 comprises a length of conventional flexible cable 98 including an outer resilient plastic sheath 98A and an inner element 99 coaxially disposed therewithin. With reference to FIG. 3, handle assembly 26 comprises a pair of individual ends 26A and 26B of generally rigid, cylindrical construction which are preferably formed of wood. The cable end which terminates within the vehicle and attaches to the handle 26 is generally designated by the reference numeral 100. There, the sheath 98A is preferably secured to handle member 26A, and is firmly routed through a suitable channel 99B defined through the interior of handle member 26A. The internal metallic element 99 terminates within lower handle member 26B.

Thus, rotation of handle member 26B relative to handle member 26A causes the inner cable element 99 to rotate relative to the sheath 98A. Similarly, limited axial movement of handle member 26B relative to handle member 26A will result in small axial movements of shaft 47.

Figure 4:
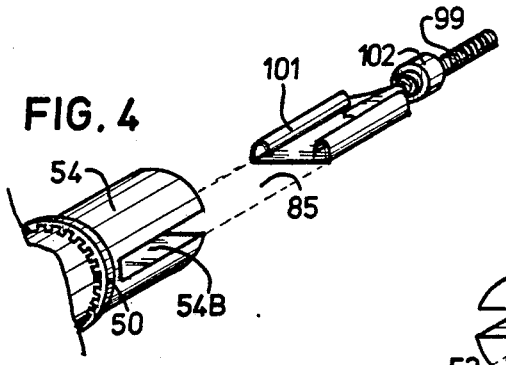
FIG. 4 is a greatly enlarged, fragmentary view of the cable control slot and the cable coupling assembly.

The extreme terminal end of cable element 99 preferably terminates in a generally flat, metallic connector 101 (FIG. 4), which is known in the electrical trades as a space connector and secured into clamp 102. Space connector 101 is adapted to be received within cable control end 54 of coupling shaft 47, being firmly press fitted into slot 54B (FIGS. 3, 4). However, the outermost extreme end of the cable sheath 98A must be appropriately terminated. Hence, with reference to FIGS. 2 and 3, a clasp for securing a terminal end of the cable assembly sheath against relative rotation has been generally designated by the reference numeral 112. This rigid metallic clasp 112 is adapted to be fitted as indicated in FIG. 2 through the stanchion 36 to project towards the cable control end 54 of shaft 47. As best viewed in FIG. 3, a pair of orifices 114, 116 are defined in stanchion 36 to receive the curved end 118 of the clasp 112. The opposite end 119 of clasp 112 includes a returning lip portion 120 which projects backwardly towards cable control end 54 and is firmly affixed against the forwardmost portion of sheath end 98A by a generally tubular, resilient sleeve 117 which grasps it with internal bushing 123. Sleeve 117 is yieldably slid back into the position illustrated in FIG. 2, once the cable is appropriately attached.

Hence movements of the cable handle assembly 26 allow slight axial movements of cable shaft 47, axial displacement being limited by washers 49, 50 (FIGS. 3, 5). Also, rotation of the handle element 26B will cause internal wire element 99 to twist relative to sheath 98A, causing controller shaft 47 to rotate within stanchion 36. This causes the airplane mounting clip 80 to rotate the toy airplane 10, and slight additional movements are also facilitated by pivoting of clip 80 relative to pin 86 (FIG. 5) against the limits established by the resilient ring 90.

Thus a plurality of aircraft movements can be caused by a child's manipulation of the handle assembly in the manner described. I have found through experimentation that the suction cup mounting arrangement on mounting plate 14 functions reliably against wind friction and forces, and that a wide variety of plastic airplane models of conventional construction will demonstrate a variety of interesting and "fun" maneuvers when attached to my toy system in the manner described.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A toy for mounting a model airplane or the like to a vehicle so that a child or other user of said toy may play with the model airplane to simulate flying as the vehicle moves, said system comprising:

a mounting plate adapted to be at least temporarily secured to said vehicle;

a manually-controlled coupling system operationally associated with and spaced apart from said mounting plate by an elongated stanchion and adapted to be coupled to said model airplane; and, an elongated cable assembly having a handle adapted to be disposed within said vehicle for operation by said user, a cable having an exterior sheath and an inner element coaxially surrounded by said sheath, said handle comprising means adapted to be grasped by said user to twist the cable inner element relative to said sheath to effectuate twisting of said coupling system and thus movement of said model airplane, and an outer terminal end of said inner element adapted to be attached to said coupling system for manipulating said model airplane as said vehicle moves, whereby to simulate flight of said model airplane in response to movement of said handle from within said vehicle.

2. The toy as defined in claim 1 wherein said coupling system comprises an elongated shaft rotatably fitted to said stanchion through a transverse bore defined within said stanchion.

3. The toy as defined in claim 2 wherein said coupling system shaft comprises a cable control end adapted to receive a terminal end of said cable assembly inner element, and said toy comprises means for securing a terminal end of said cable assembly sheath against relative rotation.

4. The toy as defined in claim 3 wherein said coupling system shaft comprises an airplane control end spaced apart from said cable control end which is adapted to be coupled to said model airplane.

5. The toy as defined in claim 4 wherein said airplane control end comprises an airplane control slot, and said toy comprises an airplane attachment clip adapted to be coupled at one end to said model airplane and coupled at its opposite end to said coupling system shaft.

6. The toy as defined in claim 3 wherein said coupling system cable control end comprises a cable control slot adapted to receive the terminal end of the inner element of said cable assembly.

7. A toy for mounting a model airplane or the like to a vehicle so that a child or other user of said toy may play with the model airplane and simulate flying as the vehicle moves, said system comprising:

a rigid, generally planar mounting plate adapted to be at least temporarily secured to a window of said vehicle;

an elongated stanchion extending outwardly from said mounting plate;

a coupling system operationally associated with said stanchion in spaced relation with respect to said plate and adapted to be coupled to said model airplane;

a handle adapted to be disposed within said vehicle for operating said coupling system to manipulate said airplane;

cable means extending between said handle and said airplane, said cable means comprising an outer terminal end adapted to be attached to said coupling system for manipulating said model airplane as said vehicle moves, said cable means comprising a sheath and an inner element coaxially surrounded by said sheath;

wherein said handle comprises means adapted to be grasped by said user for twisting the cable inner element relative to said sheath to effectuate twisting of said coupling system and thus movement of said model airplane;

whereby to simulate flight of said model airplane in response to vehicle movement from within said vehicle.

8. The toy as defined in claim 7 wherein said coupling system comprises an elongated shaft rotatably fitted to said stanchion through a transverse bore defined within said stanchion.

9. The toy as defined in claim 8 wherein said coupling system shaft comprises a cable control end adapted to receive a terminal end of said cable means inner element, and said toy comprises means for securing a terminal end of said cable means sheath against relative rotation.

* * * * *